United States Patent [19]

Eijkelenboom et al.

[11] 4,039,878

[45] Aug. 2, 1977

[54] ELECTRIC REFLECTOR LAMP

[75] Inventors: Leonard Cornelis Hendrik Eijkelenboom; Jan Antoon Henri Kesseler, both of Eindhoven, Netherlands

[73] Assignee: U.S. Philips Corporation, New York, N.Y.

[21] Appl. No.: 729,952

[22] Filed: Oct. 6, 1976

[30] Foreign Application Priority Data

Oct. 13, 1975 Netherlands ..... 7511983

[51] Int. Cl.[2] ..... H01K 1/32

[52] U.S. Cl. ..... 313/113; 313/112; 350/290; 350/294

[58] Field of Search ..... 353/55; 313/112, 113, 313/114, 115; 350/290, 294, 296

[56] References Cited

U.S. PATENT DOCUMENTS 3,494,693 2/1970 Elmer ..... 353/55

*Primary Examiner*—John Kominski

*Attorney, Agent, or Firm*—Frank R. Trifari; Robert S. Smith

[57] ABSTRACT

Electric reflector lamps having an ellipse-like curved reflector and a hyperbola-like curved IR reflector having a higher efficiency if not only the foci of both reflectors coincide and the high source is arranged on the coinciding foci present within the space enclosed by the reflectors, but the relationship $a_h = f \times c^2/a_e$ also applies, where $f$ is a factor dependent on the eccentricity of the ellipse.

6 Claims, 1 Drawing Figure

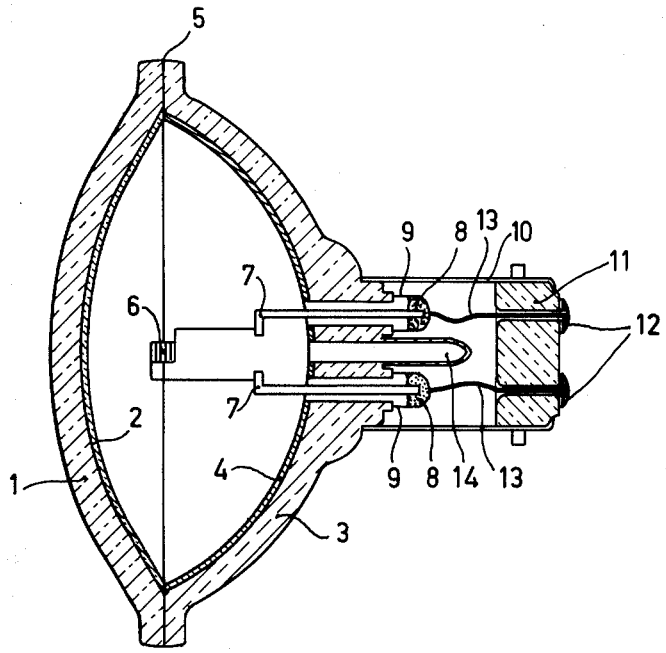
5
9
8
13
10
11
7
6
12
7
2
1
4
9
8
14
13
3

ELECTRIC REFLECTOR LAMP

The invention relates to an electric reflector lamp comprising 1. an ellipse-like curved total reflector,
2. a hyperbola-like curved, light-transmitting, thermal radiation-reflecting reflector, and
3. a light source, in which the foci of the elliptic curved reflector and the hyperbolic curved reflector coincide, the reflectors face each other with their concave surfaces, and in which the light source surrounds the coinciding foci situated within the space enclosed by the reflectors.

Such a reflector lamp is known from U.S. Pat. No. 3,494,693.

Electric light sources and notably incandescent lamps also emit thermal radiation in addition to light. Not only is the thermal radiation often annoying, in particular when the radiation of a light source is concentrated, but said radiation also implies a low useful efficiency of the light source.

In the said United States Specification it is suggested to remove these drawbacks of a light source arranged in the focus of an elliptic mirror by means of a hyperbolic, light-transmitting, thermal radiation-reflecting reflector.

Dependent of the quality of the hyperbolic reflector - the extent to which it reflects thermal radiation and passes visible radiation - the first- mentioned drawback is removed to a greater or smaller extent, associated with a smaller or larger light loss.

The second drawback, a low useful efficiency, is removed by the suggestion of the United States Patent Specification only in the theoretical case in which the light source has the dimensions of a geometrical point or line. Only in those cases is the radiation emitted by the light source reflected, directly or after reflection on the elliptic reflector, to the light source by the hyperbolic reflector. In the case in which this would be done quantitatively, the energy supplied to the light source - except for other losses - would be equal to the visible radiant energy emitted by the light source.

Since, however, every electric light source has three-dimensional dimensions, the radiation emitted by this light source is not issued, or is issued only very partly, from the foci of the reflectors.

The result of this is that, dependent on the path travelled by a thermal ray - first reflection on the hyperbolic curved surface and then on the elliptic curved surface, or conversely - the thermal image of the light source formed by the reflectors at the area of the light source is a magnification or a reduction of the light source. A magnified image implies that a part of the reflected thermal radiation does not impinge on the light source and does therefore not contribute to efficiency improvement. A reduced image means that a part of light source is heated more considerably than another part, which involves a reduced life of the light source, certainly if this is an incandescent lamp.

It is an object of the invention to improve the efficiency of an electric reflector lamp and to extend its life.

In agreement herewith, the invention relates to an electric reflector lamp of the kind mentioned in the preamble which is characterized in that the elliptic curved reflector has an eccentricity $c/a_e$ of 0.5 to 0.99 and that the elliptic curved and the hyperbolic curved reflectors satisfy the relationship $a_h = f \times c^2/a_e$, in which formula $a_h$ is half the distance between the branches of the hyperbola, $a_e$ is half the length of the major axis of the ellipse and $c$ is half the focal distance of both the hyperbola and the ellipse according to which the reflectors are curved and $f$ has a value between the limit values 0.84 and 1.14 if $c/a_e = 0.5$, while $f$ lies between limit values nearer to 1,00 according as $c/a_e$ increases, so that $f$ is between 0.998 and 1.002 if $c/a_e = 0.99$.

For further explanation of the above symbols it is to be noted that $a_e$ is the factor occurring in the mathematical formula of the ellipse: $x^2/a^2_e + y^2/b^2_e = 1$, $a_h$ is the factor of the formula of the hyperbola: $x^2/a^2_h - y^2/b^2_h = 1$, while $c^2$ satisfies the equation $c^2 = a^2_e - b^2_e = a^2_h + b^2_h$.

It was found that when using elliptic and hyperbolic reflectors which satisfy the given relationship a considerable efficiency gain is obtained. This gain is larger as the factor $f$ is nearer to 1 and is maximum when $f = 1$. In the latter case the thermal image which the reflectors give of the light source is as a matter of fact congruent therewith.

In the following table the limit values of $f$ for a few eccentricities are stated. The limit values of $f$ for eccentricities not mentioned can be found by interpolation.

| eccentricity $c/a_e$ | 0.5 | 0.7 | 0.9 | 0.95 | 0.99 |
|---|---|---|---|---|---|
| limit values of f | 0.84; 1.14 | 0.92; 1.07 | 0.97; 1.02 | 0.99; 1.01 | 0.998; 1.002 |

Although the reflectors may have an alongate shape with elliptic and hyperbolic cross-sections, respectively, lamps having ellipsoidal and hyperboloidal reflectors are to be preferred in many cases, inter alia for projection purposes. In this preferred embodiment the reflectors therefore are solids of revolution about the coinciding axes of ellipse and hyperbola.

Since thermal radiation in an electric incandescent lamp has a greater share in theirradiated energy than in other electric lamps, for example discharge lamps, the invention is advantageously applied to incandescent lamps.

The filament surrounded by an inner envelope may be accommodated in the space bounded by the reflectors, but reflector lamps are to be preferred which do not have an inner envelope and in which the lamp vessel is formed by the reflectors. The advantage of these lamps is that no efficiency loss can occur as a result of reflection of thermal radiation at the surface of an inner envelope and that no reflection of light rays on an inner envelope takes place as a result of which the concentrating effect of the elliptic reflector would be partly lost.

The filament may consist of carbon, tungsten, other hihg-melting-point metals or of metal carbides or nitrides, for example tantalum carbide, hafnium nitride.

The lamps vessel may be filled with inert gas but preferably contains a regenerative gas which returns material evaporated from the filament back to the filament. Lamps having a tungsten filament and a halogen-containing, in particular bromine-containing, filling gas are to be preferred.

The filament may consist, for example, of a wire of ribbon wound around a round or flat mandrel. In lamps having an ellipsoidal and a hyperboloidal reflector the axis of symmetry of the filament preferably has the same direction as the axis of symmetry of the reflectors.

The elliptic reflector consists generally of a transparent body, for example of glass, for example quartz glass or hard glass, coated with a reflecting layer, for example a metal layer,. However, the reflector may alternatively be of metal. In that case, or if a transparent body is coated on the concave side with metal, it will generally be recommendable to provide the concave surface with a protective layer, for example of silicon oxide. However, a glass body of which the convex surface is metallised is preferred. For that purpose, aluminium is preferably used.

The hyperbolic reflector consists in general of a transparent support, preferably glass, which is covered with a light-pervious, thermal radiation-reflecting filter.

The filter may be an interference filter but since only a part of the infrared spectrum can be covered with said filter, if a high transmission is required in the visible part of the spectrum, a combination of an interference filter and a highly doped metal oxide filter is preferably used as a filter. These are preferably provided so that the light rays emanating from the light source first pass through the interference filter and then through the metal oxide filter. It is for that purpose not necessary for both filters to be situated on the same side of the support, but both filters are preferably situated on the inside of the support.

In order to realize the highest possible reflection over a largest possible range in the infrared part of the spectrum by means of a minimum number of layer pairs each consisting of a transparent layer having a low index of refraction and a transparent layer having a high index of refraction and provided on the side remote from the light source, the substances of which the layers consist are preferably chosen to be such that the index of refraction of the substance having a high index is at least 1.5 times larger than that of the substance having a low index.

Substances having a low index of refraction are inter alia $Na_3AlF_6$, $MgF_2$ and $SiO_2$, substances having a high index are inter alia ZnSe, ZnS and $TiO_2$.

In general, filters having at least three layer pairs are used, for economical reasons preferably 4 or 5 pairs are used.

The layer thicknesses of interference filters are preferably chosen to be so that maximum reflection occurs between 0.7 and 1.2/μm, more especially at 1.0/μm and that reflections in the visible range of the spectrum are minimum.

The interference filter may alternatively consist of two stacks of which one has one or more layer pairs, preferably 5, and a maximum reflection between 0.7 and 0.9, preferably at 0.8/μm, and the other also consists of one or more layer pairs, preferably 4, and has a maximum reflection between 0.9 and 1.3, preferably at 1.1/μm.

As a highly doped metal oxide filter is preferably used a filter having a plasma wavelength of less than 1.4/μm, for example, a filter described in Netherlands Patent Application 74 108 14 (PHD. 47 147) laid open to public inspection. The filter described in said application consists of indium oxide which is doped with at least 7, preferably 7 to 20 at.percent tin calculated on indium, has a free electron density of at least $10^{21}/cm^3$, preferably between $10^{21}$ and $3 \times 10^{21}/cm^3$. This filter has generally a thickness of 0.2 – 0.5/μm, preferably 0.3 – 0.4/μm.

If an interference filter and a doped metal oxide filter are used and these are situated on the same side of the supporting member, it may be recommendable to separate them from each other by means of a layer having a low index of refraction, for example a layer of $MgF_2$ of 0.24/μm.

The invention will be described in greater detail with reference to the drawing and the example.

The drawing is a longitudinal sectional view through the axis of a reflector lamp.

A hyperboloidal pressed glass face plate 1 comprises on the inside an infrared-reflecting, light-previous layer 2. An ellipsoidal pressed glass body 3 has a metal mirror 4 on its inside. The parts 1 and 3 are sealed in a vacuum-tight manner at 5. A tungsten filament 6 connected to the supporting poles 7 is located so that the coinciding foci of the reflectors are present within the filament. The supporting poles 7 are secured to the metal caps 9 by means of hard solder, which caps are connected to the member 3 in a vacuum-tight manner. A metal lamp cap envelope 10 surrounds a glass mass 1 which has two bottom contacts 12 at its end face to which current conductors 13 are connected. A tipped-off exhaust tube is shown at 14.

EXAMPLE

A lamp as shown in the figure was made. The hyperboloidal reflector had a curvature corresponding to that of a hyperbola having a half focal distance of 38.73 mm and an $a_h$ of 30.0 mm. The pressed glass face plate 1 had an infrared filter of tin-doped indium oxide, thickness 0.3/μm, free electron density $1.3 \times 10^{21}$ cm−3, plasma wavelength 1.1/μm. On said filter was present an interference filter consisting of the following layers: On the indium oxide filter first a layer of $MgF_2$ 0.236/μm, then ZnS 0.117/μm, $MgF_2$ 0.185/μm, ZnS 0.104/μm, $MgF_2$ 0.174/μm, ZnS 0.104/μm, $MgF_2$ 0.185/μm, ZnS 0.117/μm and $MgF_2$ 0.101/μm.

The ellipsoidal reflector 3 was curved according to an ellipse having half a focal distance of 38.73 mm and half a long axis ($a_e$) of 50.0 mm. Aluminium was vapour-deposited on the concave surface. Spot-welded to Mn/Ni supporting poles 7 was a tungsten filament having a length of 1.90 mm and a diameter of 1.94 mm obtained by winding a wire of 0.245 mm diameter with a pitch of 0.33 mm on a round mandril of 1.45 mm.

The lamp vessel formed by the reflectors was filled with 1 atomosphere krypton.

What is claimed is:

1. An electric reflector lamp comprising (1) an ellipse-like curved total reflector, (2) a hyperbola-like curved, light-pervious, thermal radiation-reflecting reflector and (3) a light source in which the foci of the ellipse-like curved reflector coincide with those of the hyperbola-like curved reflector, the reflectors face each other with their concave sides, and the light source surrounds the coinciding foci situated within the space enclosed by the reflectors, characterized in that the ellipse-like curved reflector has an eccentricity $c/a_e$ of 0.5 to 0.99 and that the ellipse-like curved reflector and the hyperbola-like curved reflector satisfy the relationship $a_h = f \times c^2/a_e$, in which formula $a_h$ is half the distance between the branches of the hyperbola, $a_e$ is half the length of the long axis of the ellipse and $c$ is half the focal distance of both the hyperbola and the ellipse according to which the reflectors are curved and $f$ has a value between the limit values 0.84 and 1.14 if $c/a_e = 0.5$, while $f$ is between limit values nearer to 1.00 according as $c/a_e$ increases so that $f$ is between 0.998 and 1.002 if $c/a_e = 0.99$.

2. An electric reflector as claimed in claim 1, characterized in that $f$ has the value 1.

3. An electric reflector lamp as claimed in claim 1, characterized in that the elipse-like and the hyperbola-like curved reflectors are both solids of revolution about the coinciding axes of ellipse and hyperbola.

4. An electric reflector lamp as claimed in claim 1, characterized in that the light source is an incandescent lamp.

5. An electric reflector lamp as claimed in claim 3, characterized in that the axis of symmetry of the filament has the same direction as the axis of symmetry of the reflector.

6. An electric reflector lamp as claimed in claim 4, characterized in that the reflectors constitute the lamp vessel of the incandescent lamp.

* * * * *

UNITED STATES PATENT OFFICE

CERTIFICATE OF CORRECTION

Patent No. 4039878 Dated August 2, 1977

Inventor(s) Leonard C. H. Eijkelenboom et al

It is certified that error appears in the above-identified patent and that said Letters Patent are hereby corrected as shown below:

IN THE ABSTRACT:

Line 4, delete "high" and insert --light--.

Signed and Sealed this

*Seventeenth* Day of *October 1978*

[SEAL]

*Attest:*

RUTH C. MASON
*Attesting Officer*

DONALD W. BANNER
*Commissioner of Patents and Trademarks*